US006437638B1

(12) United States Patent
Coles et al.

(10) Patent No.: US 6,437,638 B1
(45) Date of Patent: Aug. 20, 2002

(54) LINEAR TWO QUADRANT VOLTAGE REGULATOR

(75) Inventors: Charles Coles, San Jose, CA (US); Jon R. Roman, Boynton Beach, FL (US)

(73) Assignee: Micrel, Incorporated, San Jose, CA (US)

( * ) Notice: Subject to any disclaimer, the term of this patent is extended or adjusted under 35 U.S.C. 154(b) by 0 days.

(21) Appl. No.: 09/724,854

(22) Filed: Nov. 28, 2000

(51) Int. Cl.[7] ..... G06G 7/19
(52) U.S. Cl. ..... 327/540
(58) Field of Search ..... 327/72, 73, 77, 327/530, 534, 535, 537, 538, 540, 541, 543, 545, 546

(56) References Cited

U.S. PATENT DOCUMENTS

| | | | | |
|---|---|---|---|---|
| 4,613,810 A | * | 9/1986 | Jablonski et al. | 323/271 |
| 4,908,566 A | | 3/1990 | Tesch | 323/280 |
| 5,168,209 A | | 12/1992 | Thiel | 323/313 |
| 5,317,254 A | * | 5/1994 | Olson | 323/316 |
| 5,519,309 A | * | 5/1996 | Smith | 323/316 |
| 5,625,278 A | | 4/1997 | Thiel et al. | 323/280 |
| 5,648,718 A | | 7/1997 | Edwards | 323/274 |
| 5,744,944 A | | 4/1998 | Danstrom | 323/284 |
| 5,889,393 A | | 3/1999 | Wrathall | 323/282 |
| 5,936,388 A | | 8/1999 | Casper | 323/273 |
| 6,005,378 A | | 12/1999 | D'Angelo et al. | 323/313 |
| 6,064,187 A | | 5/2000 | Redl et al. | 323/285 |
| 6,084,389 A | | 7/2000 | Gens et al. | 323/315 |
| 6,201,378 B1 | * | 3/2001 | Eto et al. | 323/313 |

OTHER PUBLICATIONS

Author Unknown, "*Bus Termination Regulator*", Micro Linear, Product Brochure, Jul. 1997, pp. 1–9.

Author Unknown, "*CMOS Programmable Micropower Positive Voltage Regulator*", Intersil, ICL7663S, Product Data Sheet, File No. 3180.3, Apr. 1999, pp. 3–55 to 3–61.

Terry Lee & Bryan Belk, "*DDR SDRAM Signaling Design Notes*", Micron Technology, Inc., Micro Linear, Apr. 1999 (Preliminary), pp. 1–12.

Author Unknown, "*Programmable Negative Voltage Regulator*", Maxim Integrated Products, Product Brochure, ICL7664, 19–3956, Rev. 2, Apr. 1995, pp. 1–8.

Author Unknown, "*Programmable Positive Voltage Regulator*", Maxim Integrated Products, Product Brochure, ICL7663, 19–0961, Rev. 1, Apr. 1994, pp. 1–8.

* cited by examiner

*Primary Examiner*—Jeffrey Zweizig
(74) *Attorney, Agent, or Firm*—Dorsey & Whitney LLP

(57) ABSTRACT

The present invention provides an apparatus and method for regulating an output to stabilize the output without limiting an output current. The regulator includes a stabilizing circuit coupled to a source circuit and a sink circuit. The source circuit is configured to source the output current to the output, and the sink circuit is configured to sink the output current from the output. The stabilizing circuit is configured to transition the source circuit and the sink circuit between a conductive state and a nonconductive state to stabilize the output based on the voltage difference between the output and a reference voltage. The source and sink circuits each include at least one N-channel MOSFET transistor to source and sink output current.

The stabilizing circuit includes a first and second amplifier, where the first amplifier couples with the sink circuit to transition the sink circuit between the conductive and nonconductive states, and the second amplifier coupled with the source circuit to transition the source circuit between the conductive and nonconductive states.

33 Claims, 7 Drawing Sheets

LINEAR TWO QUADRANT VOLTAGE REGULATOR

TECHNICAL FIELD

This invention pertains to a method and apparatus for providing a stable output voltage, and more particularly to a method and apparatus for providing large source and sink currents while maintaining a stable output voltage with significantly reduced noise and ripple.

BACKGROUND

Voltage regulators are well known in the art. These devices attempt to provide a stable, nearly constant voltage to a load. Further, these devices attempt to maintain the output voltage at the nearly constant value regardless of the current demands of the load.

Some regulators attempt to provide a stable output voltage by switching between an on state and off state, such as a switchmode solution. In such regulators, a voltage supply is switched off or short-circuited to prevent the load from receiving power from the supply, thus lowering the output voltage across the load. When the output voltage has reached a desired level, the supply is reactivated or the short is removed to allow the load to again be powered by the supply. This method provides slow response time and generally requires an excessive variation in the output voltage. Further, the switchmode techniques introduce unwanted noise into the system and output. Switchmode solutions provide voltage regulation, but generally are more costly to implement, generate excess noisy, have complicated designs and lack reliability.

SUMMARY

In accordance with the teachings of this invention a novel method and structure is taught which provides for the regulation of an output voltage to stabilize the output voltage without limiting the output current. In one embodiment, the regulator includes a stabilizing circuit coupled to a source circuit and a sink circuit. The source circuit is configured to source an output current to the output, and the sink circuit is configured to sink the output current from the output. The stabilizing circuit is configured to transition the source circuit and the sink circuit between a conductive and nonconductive state to stabilize the output based on the voltage difference between the output and a reference voltage.

In one embodiment, the source and sink circuits each include at least one N-channel MOSFET transistor to source and sink output current. The stabilizing circuit includes a first and second amplifier, where the first amplifier couples with the sink circuit to transition the sink circuit between the conductive and nonconductive states, and the second amplifier couples with the source circuit to transition the source circuit between the conductive and nonconductive states.

DETAILED DESCRIPTION

The present invention provides for the control or regulation of an output voltage supplied to a load. The method and apparatus of the present invention is capable of maintaining a stable output voltage regardless of the input voltage level, output current or desired output voltage level. Further, the present invention does not require the use of series inductance and thus avoids unwanted noise and ripple associated with other regulator solutions, such as switchmode solutions, in the substantially constant output voltage applied to the load.

Figure 1:
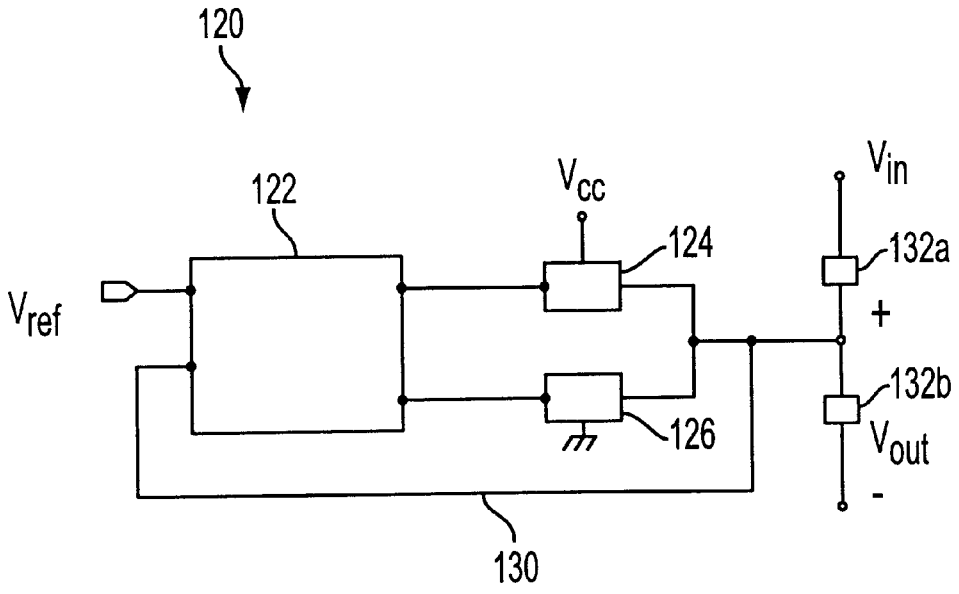
FIG. 1 depicts a simplified block diagram of one embodiment of a voltage regulator or control circuit of the present invention.

FIG. 1 depicts a simplified block diagram of one embodiment of a voltage regulator or control circuit 120 of the present invention. Control circuit 120 is designed to track an input or reference voltage $V_{ref}$. Reference voltage $V_{ref}$ is predefined and controlled by a user to achieve a desired output voltage level. In one embodiment, control circuit 120 includes a voltage stabilizing circuit 122 coupled with a current source circuit 124 and a current sink circuit 126. As the voltage level of output voltage $V_{out}$ deviates from the reference voltage $V_{ref}$, feedback path 130 provides the output voltage $V_{out}$ as a second input to voltage stabilizing circuit 122. Voltage stabilizing circuit 122 activates or deactivates source circuit 124 and sink circuit 126 accordingly to adjust output voltage $V_{out}$ to track reference voltage $V_{ref}$.

In one embodiment, when output voltage $V_{out}$ exceeds reference voltage $V_{ref}$, voltage stabilizing circuit 122 deactivates source circuit 124 and activates sink circuit 126 to adjust the output voltage $V_{out}$ to be substantially equal to the reference voltage $V_{ref}$. Alternatively, if output voltage $V_{out}$ falls below reference voltage $V_{ref}$, stabilizing circuit 122 deactivates sink circuit 126 and activates source circuit 124 to source output current to a load 132*a–b*. Where the load 132 is substantially any load, such that, in one embodiment, one of load 132*a* or 132*b* is eliminated. Output voltage $V_{out}$ is maintained in a linear, non-switchmode fashion. As such, the present invention reduces the amount of noise and ripple applied to the load. Further, because control circuit 120 of the present invention utilizes both a source and a sink circuit, the present invention is able to provide a substantially constant output voltage regardless of the input voltage, the output voltage $V_{out}$ or output current $I_{out}$. The present invention provides faster response time and significantly reduced output voltage ripple compared to prior art regulators including switchmode regulators. Further, the control circuit 120 provides a simpler layout and design at a reduced cost than is provided by prior art regulators without the noise associated with switchmode regulators.

Figure 2:
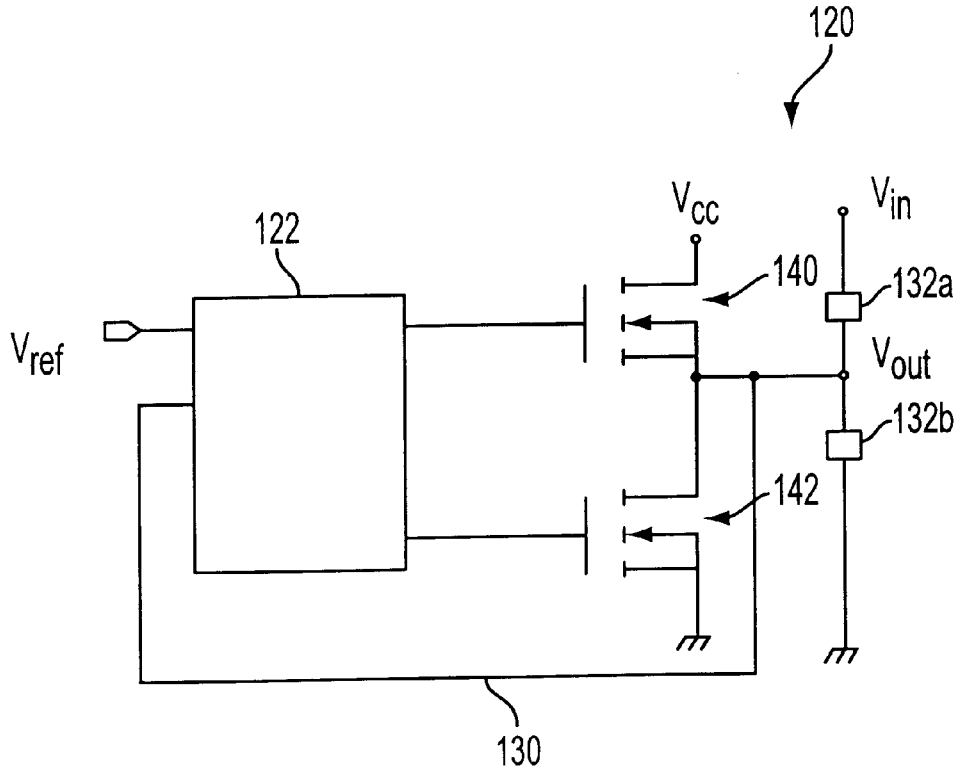
FIG. 2 depicts a block diagram of one implementation of one embodiment of the control circuit of the present invention.

In one embodiment, both source circuit 124 and sink circuit 126 are configured through MOSFET transistor technology. FIG. 2 depicts a block diagram of one implementation of one embodiment of control circuit 120. In the embodiment depicted in FIG. 2, source circuit 124 is implemented with a high-side source MOSFET transistor 140, and sink circuit 126 is implemented with a low-side sink MOSFET transistor 142. Both source and sink transistors 140, 142 are implemented through N-channel MOSFET technology. When the level of the output voltage $V_{out}$ rises above the predefined reference voltage $V_{ref}$, feedback path 130 signals stabilizing circuit 122. The stabilizing circuit 122 deactivates high-side source transistor 140 and activates low-side sink transistors 142 to pull the output voltage $V_{out}$ back to a voltage level substantially equal to the reference voltage $V_{ref}$. If output voltage $V_{out}$ falls below the reference voltage, feedback loop 130 signals stabilizing circuit 122 which in turn deactivates low-side sink transistor 142 and activates high-side source transistor 140 to source current to load adjusting output voltage $V_{out}$ to a level substantially equal to reference voltage $V_{ref}$.

One of the advantages provided by the use of MOSFET transistors in the output stage of control circuit 120 is that control circuit 120 provides relatively large currents to a load 132*a–b* while still maintaining the output voltage $V_{out}$ at a voltage level substantially equal to that of the reference voltage $V_{ref}$. Additionally, in one embodiment, MOSFET transistors are configured as N-channel transistors. As such, source transistor 140 and sink transistors 142 require less chip real estate when voltage control circuit 120 is implemented through microchip designs. The use of MOSFET transistors provides relatively large output currents $I_{out}$ with relatively low voltage requirements. Further, in one embodiment, the present invention is implemented utilizing N-channel MOSFETs for both the source and sink transistors 140, 142, thus allowing substantially equal activation voltages, temperature response, gain control and output currents. Thus, allowing the current regulator to provide superior voltage stability. MOSFET gate drive control current requirements are significantly less than that of bipolar transistors, resulting in a more efficient design with reduced bias current requirements. Bipolar transistors are generally significantly slower due to the stored charge that must be overcome when switching from an off state to a conducting state or visa versa. In one embodiment, with the use of MOSFET transistors and an additional bias voltage, the present control circuit 120 can operate at voltage levels of down to virtually zero volts input. As lower voltages are required for faster logic devices, the present invention is equally applicable to faster logic devices.

Figure 3A:
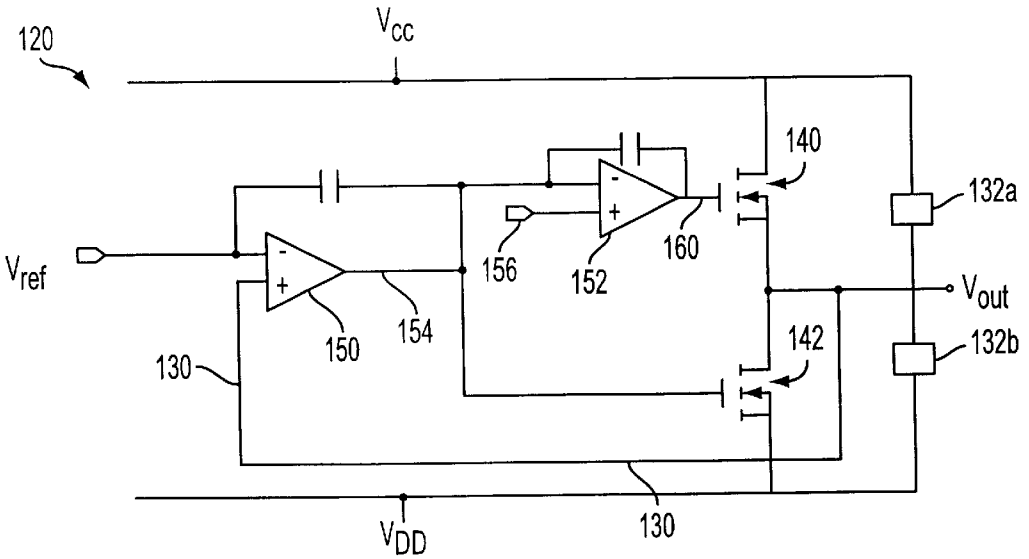
FIG. 3A shows one implementation of one embodiment of the voltage control circuit similar to those shown in FIGS. 1 and 2, where the voltage stabilizing circuit includes a pair of amplifiers.

FIG. 3 shows one implementation of one embodiment of voltage control circuit 120 wherein voltage stabilizing circuit 122 includes a pair of amplifiers. The first amplifier 150 receives reference voltage $V_{ref}$ as an input to the negative terminal. Feedback path 130 is fed back into the positive terminal of first amplifier 150. First amplifier 150 generates an error control signal 154 which is proportional to the difference between reference voltage $V_{ref}$ and output voltage $V_{out}$. First amplifier 150 couples with sink transistor 142 and second amplifier 152. Error control signal 154 is supplied to sink transistor 142 to activate sink transistor when the voltage level of error control signal 154 exceeds the gate-to-source voltage $V_{gs}$ of sink transistor 142. Error control signal 154 is also supplied to a negative terminal of second amplifier 152. A bias voltage 156 provides the input to a positive terminal of second amplifier 152. When the voltage level of error control signal 154 falls below bias voltage 156, second amplifier 152 generates a source activation signal 160. When the voltage level of source activation signal 160 exceeds a gate-to-source voltage $V_{gs}$ of source transistor 140, source transistor is activated to supply output current $I_{out}$ to load 132. In one embodiment, an optional capacitance 158 is coupled across the second amplifier 152 between the negative terminal of second amplifier 15 and source activation signal 160.

When output voltage $V_{out}$ drops below reference voltage $V_{ref}$, first amplifier 150 outputs a low or zero voltage level error control signal 154 which pulls the voltage at the negative terminal of second amplifier 152 below bias voltage 156. As the voltage at the negative terminal of the second amplifier falls below bias voltage 156, second amplifier outputs an amplified positive source activation signal 160. Once the difference between the voltage levels of error control signal 154 and bias voltage 156 exceeds a predefined threshold voltage, the voltage level of source activation signal 160 will exceed the gate-to-source voltage $V_{gs}$ of source transistor 140. Once the gate-to-source voltage level is exceeded, source transistor is activated to supply output current $I_{out}$ to the load 132 resulting in an increase in output voltage $V_{out}$. Output voltage $V_{out}$ is continuously fed back to first amplifier 150 through feedback path 130. If output voltage $V_{out}$ rises above reference voltage $V_{ref}$, first amplifier 150 generates a positive amplified error control signal 154. As the difference between the voltage levels of output voltage $V_{out}$ and reference voltage $V_{ref}$ increases, error control signal 154 increases. The increased voltage level of error control signal 154 results in a decrease in the voltage levels between the negative terminal (error control signal 154) and the positive terminal (bias voltage 156) of second amplifier 152. The decrease in the difference between the error control signal 154 and bias voltage 156 causes a decrease in source activation signal 160. Once the voltage level of source activation signal 160 falls below gate-to-source voltage $V_{gs}$ of source transistor 140, source transistor 140 is shut off, halting the supply of output current $I_{out}$ to load 132.

Once the voltage level of error control signal 154 increases to a voltage level which exceeds the gate-to-source voltage $V_{gs}$ of sink transistor, sink transistor is activated. Sink transistor 142 will then begin to sink output current $I_{out}$ from load 132 pulling output voltage $V_{out}$ down. Thus, in one embodiment, voltage control circuit 120 provides a stable output voltage $V_{out}$ which is maintained at a voltage level substantially equivalent to reference voltage $V_{ref}$ by both sourcing and sinking output current $I_{out}$.

In one embodiment, bias voltage 156 is predetermined to prevent crossconduction of output current $I_{out}$ from source transistor 140 to sink transistor 142. For example, bias voltage 156 is predefined to be substantially equal to gate-to-source voltage $V_{gs}$ of sink transistor 142. Thus, sink transistor 142 is shut off to prevent output current $I_{out}$ from being sunk from load 132 prior to second amplifier 152 generating the source activation signal 160 at a sufficient level to activate source transistor 140. Thus, crossconduction is prevented.

In one embodiment, bias voltage 156 is set to a voltage level greater than the voltage at which the sink transistor 142 will begin to conduct. The voltage level of error control signal 154 is maintained at a voltage level essentially equal to the bias voltage level 156 while the source transistor 140 is conducting. Thus, the time required for the sink transistor 142 to transition from a nonconducting or off state to a conducting (on) state is minimized.

In one embodiment, while the sink transistor 142 is conducting, the gate to source voltage $V_{gs}$ of the source transistor 140 is approximately equal to the output voltage—$V_{out}$. To achieve improved transition speeds, the source activation signal 160 output by the second amplifier 152 is clamped to a voltage potential which is slightly less than the gate to source a voltage $V_{gs}$ of the source transistor 140 while the source transistor 140 is in a nonconducting (off) state. This provides similar speed advantages for transitioning from a nonconductive to a conductive state as those described with respect to the sink transistor 142 when it is in the off state. As an example, the gate of the source transistor 140 is clamped at a voltage of up to one volt above the output voltage $V_{out}$ while the source transistor 140 is in the off state. This reduces the time required for source transistor 140 to reach a gate drive potential to activate the source transistor and prevent the second amplifier 152 from entering into a saturated off state that would required an excessively long time from which to recover.

In one embodiment, first amplifier 150 is fixed such that error control signal 154 is fixed at a voltage level just less than the gate-to-source voltage $V_{gs}$ of sink transistor 142 when the voltage at the negative input terminal exceeds the voltage at the positive input terminal of the first amplifier 150 (i.e., output voltage $V_{out}$ is less than reference voltage $V_{ref}$). This results in a reduce response time needed to transition the control signal 154 to a voltage level greater than $V_{gs}$. Thus reducing the response time needed to activate the sink transistor 142 when the output voltage $V_{out}$ exceeds the reference voltage $V_{ref}$. In one embodiment, second amplifier 152 is also fixed as described above such that source activation signal 160 is also fixed at a voltage level just less than the $V_{gs}$ voltage of source transistor 140 to allow for faster response time.

Figure 3B:
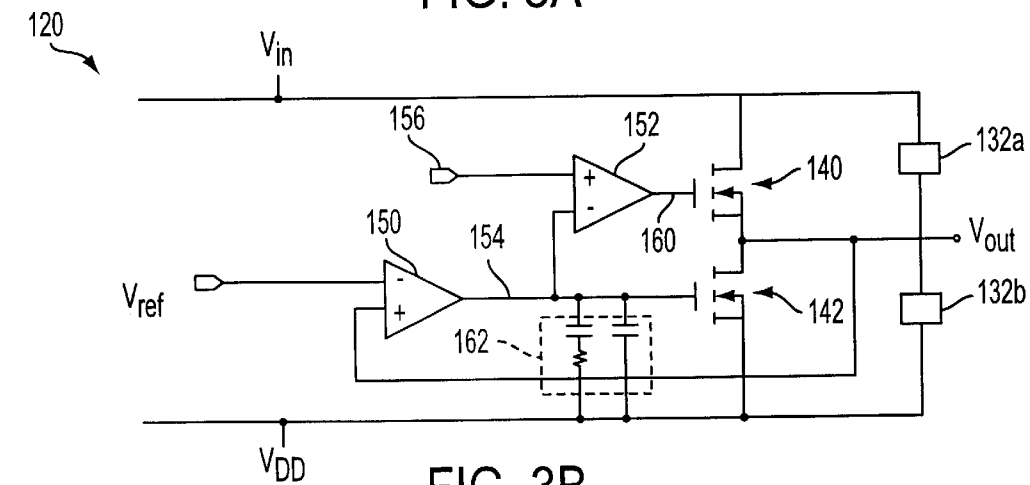
FIG. 3B shows one implementation of one embodiment of the voltage control circuit similar to those shown in FIGS. 1, 2 and 3A, where the voltage stabilizing circuit includes at least one transconductance amplifier.

FIG. 3B shows an alternative embodiment of the control circuit 120 utilizing transconductance amplifiers for one or both of first and second amplifiers 150, 152. In this embodiment, a compensation network 162 is coupled between error control signal 154 and VDD to provide compensation for control circuit 120.

Figure 4:
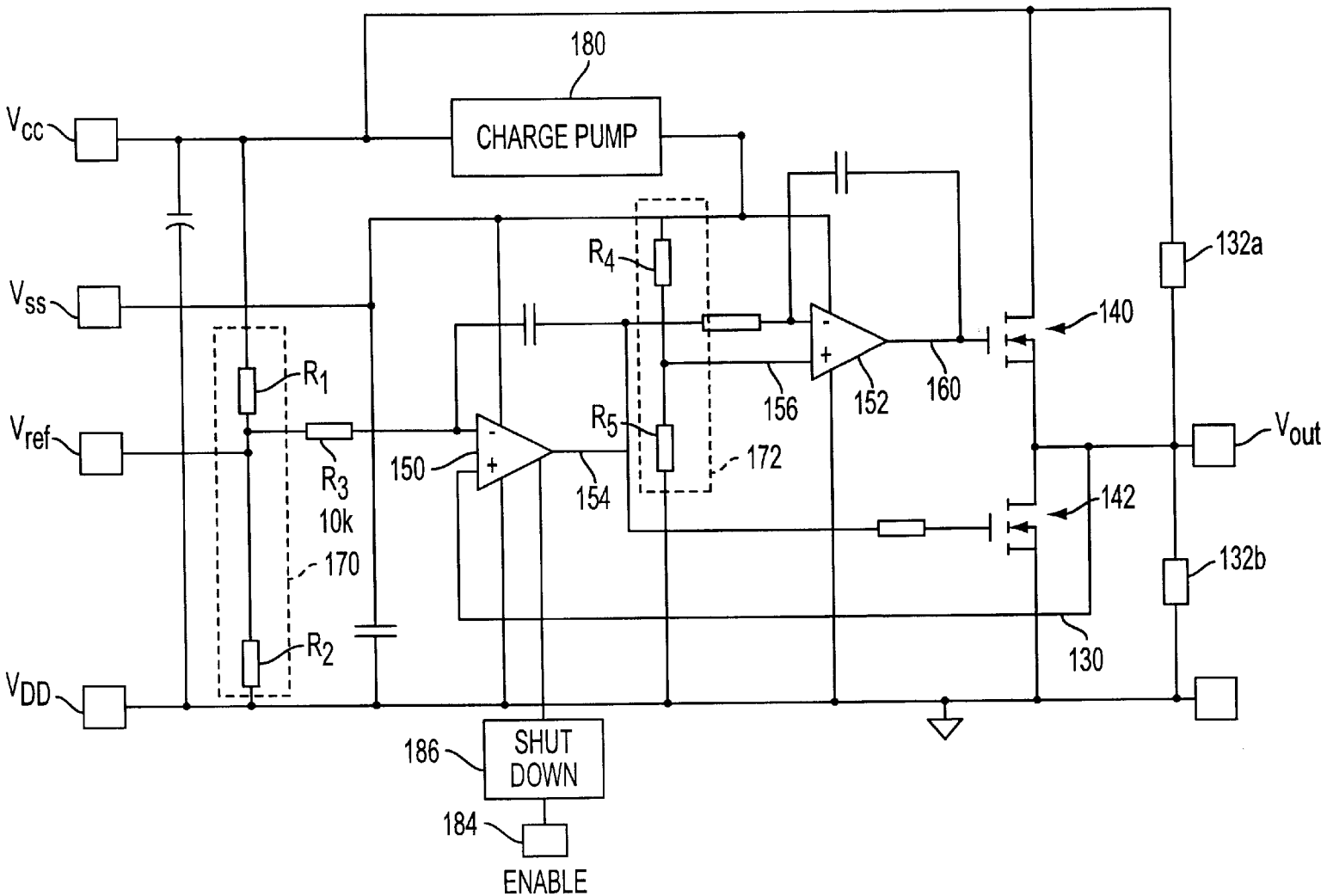
FIG. 4 shows an alternative implementation of one embodiment of the voltage control circuit of the present invention.

FIG. 4 shows one implementation of one embodiment of the voltage control circuit 120 of the present invention. Voltage control circuit 120 depicted in FIG. 4 is similar to the voltage control circuit depicted in FIGS. 3A and 3B, such that the control circuit 120 includes a first and second amplifiers 150, 152, source and sink transistor 140, 142, feedback path 130 and load 132. The embodiment shown in FIG. 4 further includes an example of one embodiment of a first and second resistive network 170, 172. First and second resistive networks 170, 172 provide control circuit 120 with the reference voltage $V_{ref}$ level, and the bias voltage 156 level. First resistive network includes resistor R1 coupled with a first source voltage VCC, and in series with resistor R2. Resistor R2 is further coupled with a second source voltage VDD. As such, voltage reference $V_{ref}$ is substantially equal to the voltage divided between R1 and R2. Similarly, the second resistive network includes resistor R4 coupled in series with resistor R5. Resistor R4 further couples with a third source voltage VSS, and resistor R5 further couples with second source voltage VDD. Thus, bias voltage 156 is defined by the voltage division between R4 and R5. It will be apparent to one skilled in the art that alternative resistive configurations can be implemented to generate the desired reference voltage $V_{ref}$ and bias voltage 156 without departing from the inventive aspects of the present invention.

As an example, assume reference voltage $V_{ref}$ is defined as one half VCC, as is often the case when implemented in stub series terminated logic (SSTL) applications, where VCC is defined as a positive 2.0V, and VDD is defined as ground or zero volts. As such, resistors R1 and R2 would be set at equal resistance values, dividing VCC in half, resulting in a reference voltage $V_{ref}$ equal to 1.0V. Assume that a gate-to-source voltage $V_{gs}$ of 1.0V is needed to activate both source and sink transistors 140, 142. As such, bias voltage is set to approximately 1.0V to avoid crossconduction. If third voltage VSS is defined as 3.0V, setting R4 equal to twice that of R5 will result in a 2.0V drop across R4 resulting in a 1.0V bias voltage 156. During operation of control circuit 120, if output voltage $V_{out}$ rises above the 1.0V reference voltage $V_{ref}$, the voltage at the positive terminal of first amplifier 150 also rises above reference voltage $V_{ref}$ through feedback path 130. First amplifier 150 begins to generate a positive error control signal 154 proportional to the difference between reference voltage $V_{ref}$ and output voltage $V_{out}$. As the difference between $V_{out}$ and $V_{ref}$ increases, the voltage level of error control signal 154 will increase to a voltage which exceeds the 1.0V bias voltage 156. As the voltage level of error control signal 154 increases, the difference between the voltage levels of the error control signal 154 and bias voltage 156 decreases resulting in a reduction in the voltage level of source activation signal 160. As the source activation signal 160 falls below the 1.0V gate-to-source voltage $V_{gs}$ offset by the output voltage $V_{out}$ of source transistor 140, source transistor 140 will be deactivated, and thus output current $I_{out}$ will no longer be sourced to the load. As output control voltage 154 exceed the 1.0 V gate-to-source voltage $V_{gs}$ of sink transistor 142, sink transistor 142 is activated sinking output current $I_{out}$ from load 132 decreasing the output voltage $V_{out}$.

As a further example, if output voltage $V_{out}$ falls below reference voltage $V_{ref}$, error control signal 154 begins to drop. As the voltage level of error signal 154 falls below the 1.0V gate-to-source voltage $V_{gs}$ of sink transistor 142, the sink transistor transitions to a nonconductive state preventing sink transistor 142 from sinking further output current $I_{out}$ from load 132. As the voltage level of error control signal 156 drops below the 1.0V bias voltage 156, second amplifier 152 increases the voltage level of source activation signal 160. Once the difference between the voltage levels of error control signal 154 and bias voltage 156 exceeds a predefined voltage level, the voltage level of source activation signal 160 will have increased to a level exceeding the 1.0V gate-to-source voltage $V_{gs}$ threshold of source transistor 140, transitioning source transistor 140 to a conductive state to source output current $I_{out}$ to load 132 causing output voltage $V_{out}$ to being to increase.

In one embodiment, voltage control circuit 120 is provided to a user as a single unit with reference voltage $V_{ref}$ defined by preexisting first resistive network 170, and bias voltage defined by preexisting second resistive network 172. However, user is still able to define reference voltage $V_{ref}$ and bias voltage 156 by adding additional resistance to first and second resistive network 170, 172 to control the voltage level of reference voltage $V_{ref}$ and bias voltage 156, respectively.

In one embodiment, the voltage regulator of the present invention is implemented to supplying a stable output voltage for SSTL applications. As such, output voltage $V_{out}$ is configured to track one half the input voltage. As described above, first resistive network divides the input voltage providing a reference voltage $V_{ref}$ equal to one half VCC. However, the configuration of first resistive network allows a user to define the reference voltage $V_{ref}$. The present invention is also equally applicable to GTL+, HSTL, VL-TTL and other such similar technologies. Thus, the apparatus and method of the present invention provides a universal solution for voltage control regardless of the input voltage.

By utilizing MOSFET transistors, control circuit 120 is capable of supplying a large output current $I_{out}$ while maintaining output voltage $V_{out}$ at a voltage level substantially equivalent to reference voltage $V_{ref}$. Source and sink circuits 124, 126 are implemented through substantially any conventional MOSFET configuration providing sufficient current to satisfy load demands known in the art. In one embodiment, source and sink transistors 140, 142 are implemented utilizing SUD50N02-06 MOSFETs from Vishay Siliconix, of Monre, Conn. With the implementation of the SUD50N02-06 MOSFETs, voltage control circuit 120 is capable of supplying a substantially constant voltage while sourcing and sinking an output current $I_{out}$ of approximately 40 Amps. However, it will be clear to one skilled in the art that the present invention is capable of sinking or sourcing any amount of current without departing from the inventive aspects of the present invention.

First and second amplifiers 150, 152 are implemented through any convenient manner, including conventional operational amplifiers, transconductance error amplifiers, customized amplifiers and any amplifiers known in the art. With the implementation of transconductance error amplifiers, the present invention provides the capability to incorporate integrating capacitors externally to the voltage control circuit 120. In one embodiment, this allow for the isolation of reference voltage filter capacitors from a compensation network coupled between error control signal 154 and VDD.

In one embodiment, voltage control circuit 120 is incorporated into a single microchip design. As such, a user controls the reference voltage $V_{ref}$ by coupling an external resistive network to the first resistive network 170, through an external pin, to adjust and control the voltage level of reference voltage $V_{ref}$.

Figure 5A:
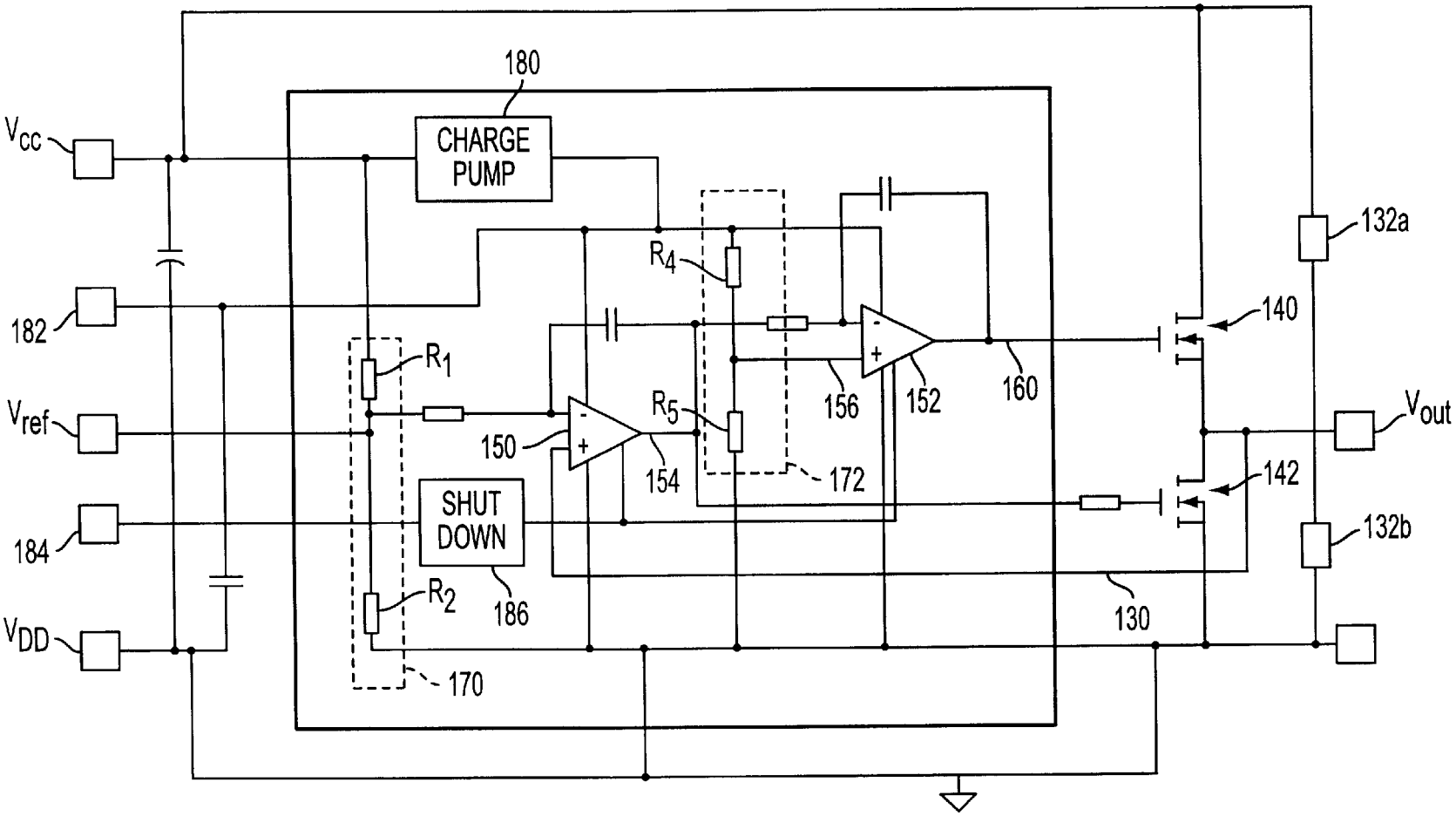
FIGS. 5A and 5B depict one implementation of one embodiment of the voltage control circuit, where the stabilizing circuit is configured as a single packaged microchip coupled with external source and sink circuits.

FIG. 5A depicts one implementation of one embodiment of the present invention wherein stabilizing circuit 122 is configured as a single packaged microchip coupled with external source and sink circuits 124, 126. The embodiment shown in FIG. 5 includes first and second amplifiers 150, 152, and first and second resistive networks 170, 172. Additionally, the stabilizing circuit 122 shown in FIG. 5 includes a charge pump 180 to provide internal biasing of first and second amplifiers 150, 152. An external bias 182 is also included in stabilizing circuit 122. External bias 182 allows user to set the voltage level of the third supply voltage VSS overriding charge pump 180. An enable signal 184 is also included in one embodiment with a shutdown unit 186 which couples at least with first amplifier 150 to deactivate first amplifier 150, and thus deactivates voltage control circuit 120. In one embodiment, shutdown unit 186 couples with both first and second amplifiers 150, 152 to deactivate both the first and second amplifiers and thus deactivate the control circuit 120. In the embodiment shown in FIG. 5A, the control circuit 120 is implemented in an 8-pin package wherein, enable 184 is a first pin, VCC is a second pin, external bias 182 is a third pin, VDD (or ground) is a fourth pin allowing a user to couple an additional resistive network to adjust the voltage level of reference voltage $V_{ref}$, reference voltage $V_{ref}$ is a fifth pin, source activation signal 160 to activate and deactivate source circuit 124 is a sixth pin, error control signal 154 to activate and deactivate sink circuit 126 is a seventh pin, and feedback path 130 is an eighth pin.

Figure 5B:
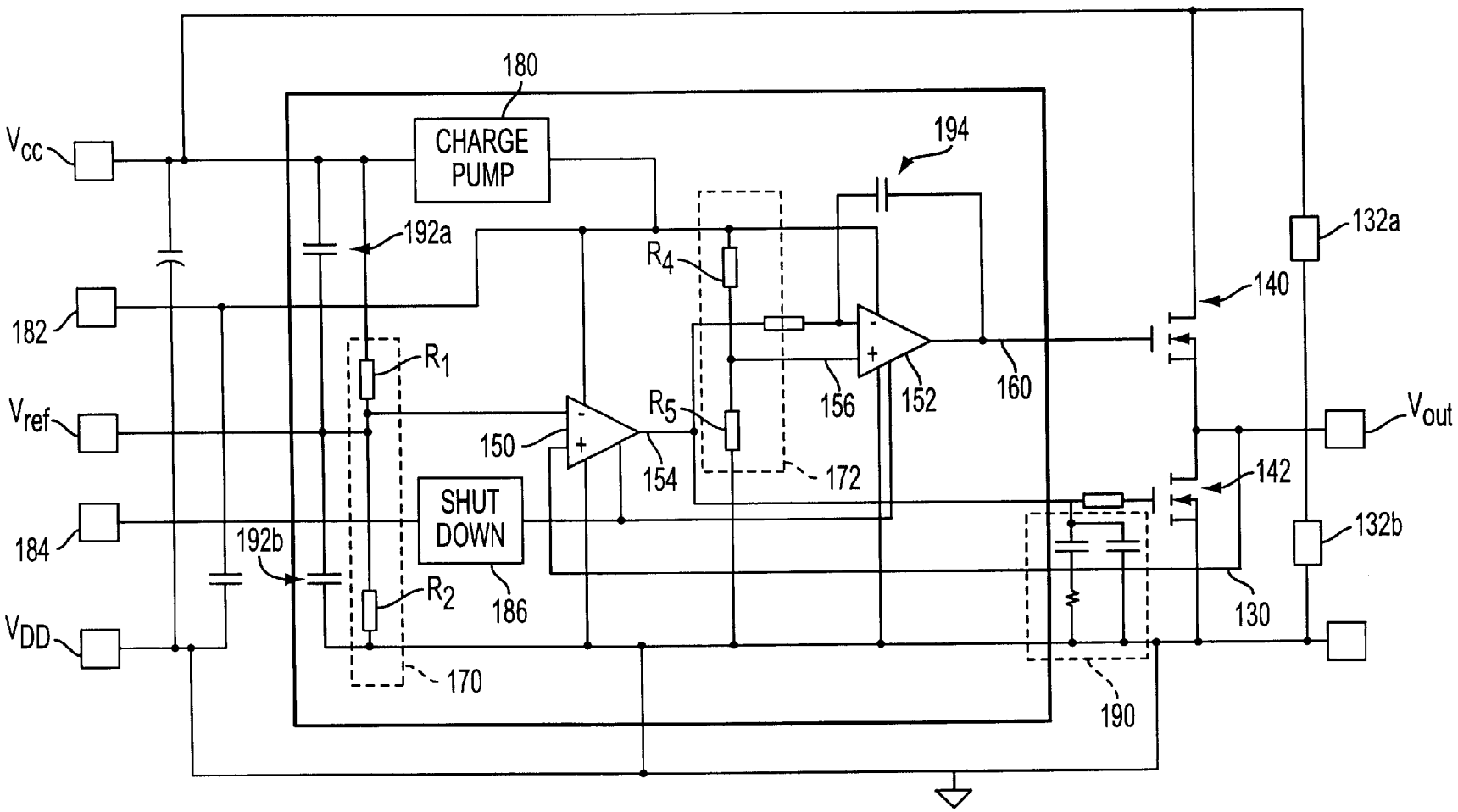

FIG. 5B depicts and alternative embodiment of control circuit 120 implemented in an 8-pin package. In the embodiment depicted in FIG. 5B, at least the first amplifier 150 is implemented with a transconductance amplifier. Further, the embodiment includes a compensation network 190 coupled between error control signal 154 and VDD. Optional filter capacitors 192*a–b* are also depicted coupled with reference voltage $V_{ref}$ to provide filtering for reference voltage $V_{ref}$. In one embodiment, filter capacitors 192*a–b* are implemented external to the package. Utilizing a transconductance amplifier for first amplifier 150 allows for compensation of the feedback loop 130 independently of any filtering provided by filtering capacitors 192*a–b* that may be required at the reference voltage $V_{ref}$ supplied to first amplifier 150. In one embodiment, compensation network 190 is configured such that compensation network 190 couples between error control signal 154 outputted by first amplifier 150 and VDD at the exterior of the 8-pin package. This provides the user with the ability to select compensation components for the compensation network 190 in order to optimize bandwidth. In one embodiment, an optional capacitance 194 is utilized across second amplifier 152 to provide additional control, however this capacitance is optional and not required in providing the stable output voltage $V_{out}$.

Figure 6:
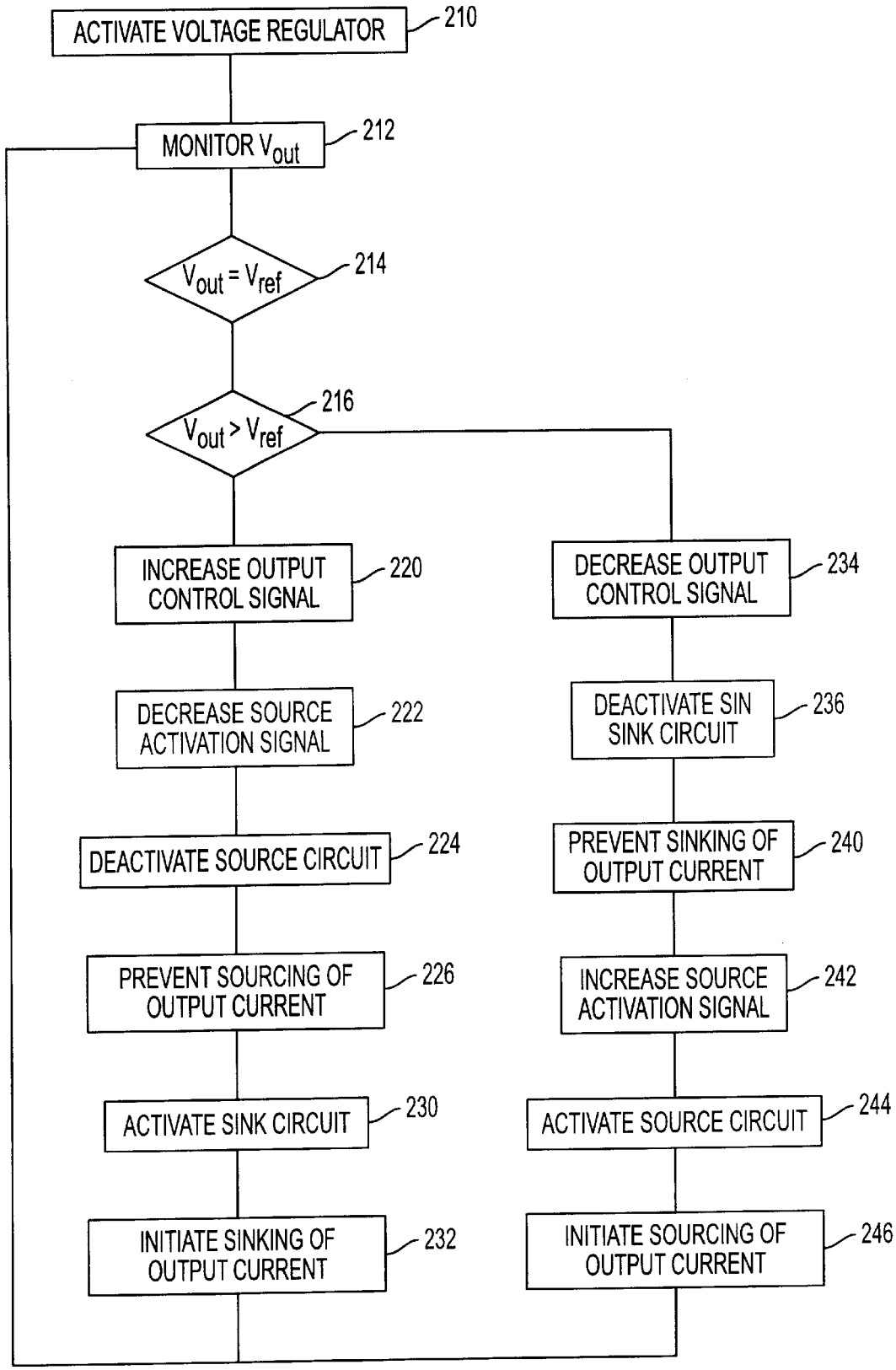
FIG. 6 depicts a flow diagram of one implementation of the process or method of the present invention for providing a stable output voltage while allowing a large variation in output current.

FIG. 6 depicts a flow diagram of one implementation of the process or method of the present invention for providing a stable output voltage $V_{out}$ while allowing a large variation in output current $I_{out}$. In step 210 voltage regulator 120 is activated. In step 212 output voltage $V_{out}$ is monitored with respect to reference voltage $V_{ref}$ through feedback path 130. In step 214 it is determined if output voltage $V_{out}$ is substantially equal to reference voltage $V_{ref}$. If output voltage $V_{out}$ is substantially equal to reference voltage $V_{ref}$, the method returns to step 212 to continue to monitor output voltage $V_{out}$. If output voltage $V_{out}$ is not substantially equal to reference voltage $V_{ref}$, step 216 is entered where it is determined if output voltage $V_{out}$ is greater than reference voltage $V_{ref}$. If output voltage $V_{out}$ is greater than reference voltage $V_{ref}$, an error control signal 154 is increased in step 220. In step 222 a source activation signal 160 is decreased if the voltage level of error control signal 154 is greater than bias voltage 156. In step 224 source circuit 124 is deactivated. In step 226 output current $I_{out}$ is no longer sourced to load 132. In step 230 sink circuit 126 is activated. In step 232 output current $I_{out}$ is sunk from load 132. Following step 232, the process returns to step 212 to continue to monitor the output voltage $V_{out}$ in relation to the reference voltage $V_{ref}$.

Going back to step 216, if output voltage $V_{out}$ is not greater than reference voltage, then the process shifts to step 234 where error control signal 154 is decreased. In step 236 the sink circuit 126 is deactivated. In step 240 the sinking of output current $I_{out}$ from load 132 is prevented. In step 242 the voltage level of source activation signal 160 is increased if the voltage level of error control signal 154 is less than bias voltage 156. Source circuit 124 is activated in step 244. In step 246 output current $I_{out}$ is sourced to load 132. The process then shifts back to step 212 to again monitor output voltage $V_{out}$ in relation to reference voltage $V_{ref}$.

In one embodiment, the regulator of the present invention as described above offers a simplified JEDEC compliant solution for terminating high-speed, low-voltage digital buses, including but not limited to, GTL+, SSTL, HSTL, LV-TTL, and any other bus termination known in the art without the need of serial inductance, thus producing a more stable output voltage. The regulator can be utilized with memory devices such as DRAMs, SDRAMs and any other conventional memory device. The present invention is easily implemented with substantially any component needing a constant supply voltage.

Figure 7A:
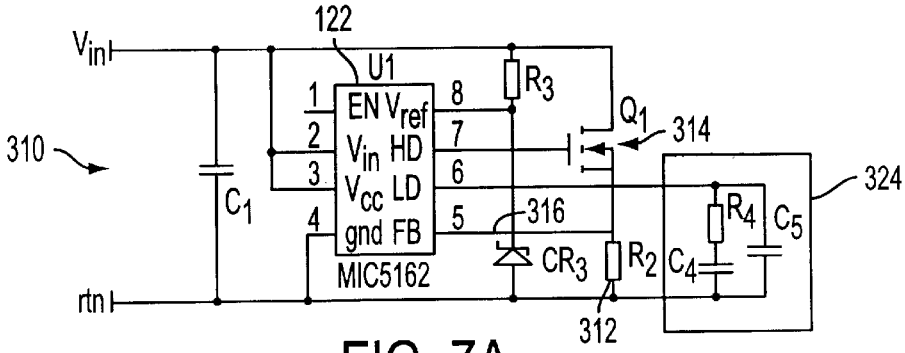
FIG. 7A depicts one implementation of the control circuit of the present invention implemented to realize a constant current sink.
Figure 7B:
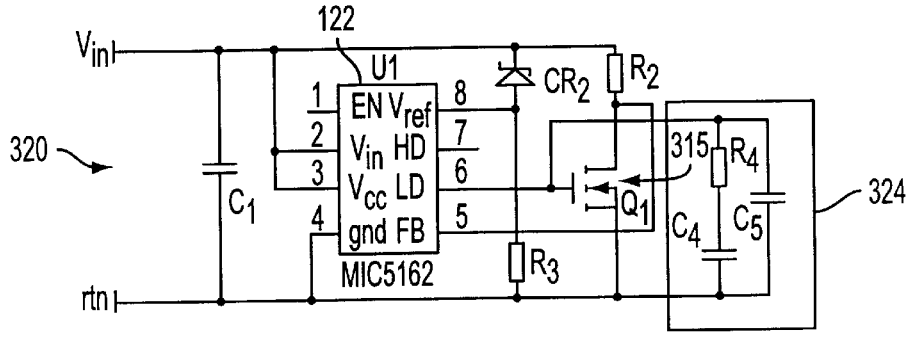
FIG. 7B shows an alternative embodiment of a constant current sink which provides a compliance range roughly equal to the input voltage.

FIGS. 7A–D provide alternative embodiments for the implementation of the stabilizing circuit 122 of the present invention. FIG. 7A depicts one embodiment of the control circuit 120 of the present invention implemented to realize a constant current sink 310. Constant current sink 310 is realized by placing a current sense resistor 312 in series with the source terminal of the high side drive MOSFET transistor 314. The voltage developed across the current sense resistor 312 is coupled through feedback 316. In one embodiment reference voltage $V_{ref}$ is modified to program a load current. The compliance range is limited to the input voltage $V_{in}$ minus the gate drive voltage of high side transistor 314. In an alternative embodiment, the constant current sink circuit 310 is configured to provide a compliance range equal to the input voltage $V_{in}$. FIG. 7B shows an alternative embodiment of a constant current sink 320 which provides a compliance range roughly equal to the input voltage. Since the sense resistor 312 and the reference voltage are referenced from the input voltage $V_{in}$, a simple resistive divider is used for the reference voltage $V_{ref}$.

Figure 7C:
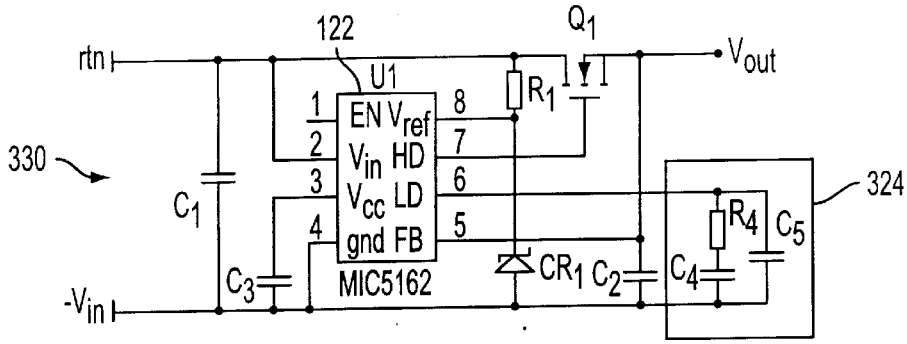
FIG. 7C shows one embodiment of a positive output linear regulator with current capability limited only by the MOSFET transconductance and thermal properties configured utilizing control circuit.

FIG. 7C shows one embodiment of a positive output linear regulator 330 with a current capability limited only by the MOSFET transconductance and thermal properties configured utilizing control circuit 120. In this embodiment only the high side transistor 314 is required.

Figure 7D:
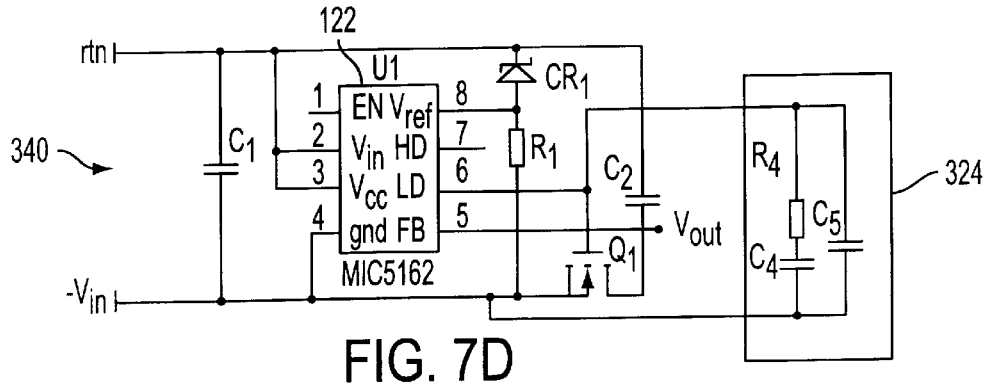
FIG. 7D shows one embodiment of a negative output linear regulator with current capability limited only by the MOSFET transconductance and thermal properties configured utilizing control circuit.

FIG. 7D shows one embodiment of a negative output linear regulator 340 with current capability limited only by the MOSFET transconductance and thermal properties configured utilizing control circuit 120. In this configuration only the low side transistor 315 is required.

In the embodiments depicted in FIGS. 7A–D, the circuits have the advantage that if the first error amplifier 150 is a transconductance amplifier, then the compensation network 324 is place at an LD pin of the device.

In one embodiment, bipolar NPN transistors are utilized in place of or in cooperation with the MOSFET source and sink transistors 140, 142. In this embodiment, the second amplifier 152 provides a large amount of gain, as appose to integration, providing a threshold level voltage for switching from the high side to the low side transistor at the high side drive.

In one embodiment, the series arrangement of first and second amplifiers 150, 152 enables the first amplifier 150 to act as the error amplifier for both sourcing and sinking conditions. Thus allowing seamless transitions from sourcing current to sinking current at the output. The second amplifier 152 sets the transition for transitioning from a low side driver to a high side driver, while providing a high side gate drive.

In one embodiment, the present invention provides a transient response which is at least equivalent to and usually better than prior art low dropout (LDO) voltage regulator (single quadrant or otherwise). Further, the present invention provides a bandwidth which is at least as good as and usually better than prior art single quadrant LDO or switchmode regulators. One advantage provided by the present invention is that the source and sink transistors 140, 142, allow active control of the output voltage $V_{out}$.

The foregoing description of specific embodiments and examples of the invention have been presented for the purpose of illustration and description, and although the invention has been illustrated by certain of the preceding examples, it is not to be construed as being limited thereby. They are not intended to be exhaustive or to limit the invention to the precise forms disclosed, and obviously many modifications, embodiments, and variations are possible in light of the above teaching. It is intended that the scope of the invention encompass the generic area as herein disclosed, and by the claims appended hereto and their equivalents. The invention now being fully described, it will be apparent to one of ordinary skill in the art that many changes and modifications can be made thereto without departing from the spirit or scope of the appended claims.

What is claimed is:

1. A two-quadrant regulator providing a stable output Vo, comprising:

an output current source circuit;

an output current sink circuit;

a source of reference voltage Vref;

a source of bias voltage Vbias;

a stabilizing circuit coupled to said output current source circuit, to said output current sink circuit, to a fraction k ($0<k<1$) of said Vo, to said Vref, and to said Vbias;

said stabilizing circuit configured to couple a signal proportional to ($k \cdot Vo - Vref$) to an input node of said output current sink circuit, and to couple a signal proportional to ($Vbias - k \cdot Vo + Vref$) to an input node of said output current source circuit;

wherein said stabilizing circuit transitions said output current source circuit and said output current sink circuit between conductive and non-conductive states to stabilize magnitude of said Vo as a function of relative magnitudes of $k \cdot Vo$ and Vref and Vbias.

2. The regulator of claim 1, wherein:

said output current source circuit includes an NMOS device having a gate lead as an input node; and said output current sink circuit includes an NMOS device having a gate lead as an input node.

3. The regulator of claim 1, wherein:

said output current source circuit includes a first NMOS device having a gate lead as an input node; and said output current sink circuit includes a second NMOS device having a gate lead as an input node;

when ($k \cdot Vo \leqq Vref$), said stabilizing circuit causes said first NMOS device to source output current, and prevents said second NMOS device from sinking output current; and when ($k \cdot Vo \geqq Vref$), said stabilizing circuit prevents said first NMOS device from sourcing output circuit, and causes said second NMOS device to sink output current.

4. The regulator of claim 1, wherein:

when said output current source circuit sources current, said output current sink circuit does not sink current; and when said output current sink circuit sinks current, said output current source circuit does not source current.

5. The regulator of claim 1, wherein:

when said stabilizing circuit activates said output current source circuit, said output current sink circuit is inactivate; and when said stabilizing circuit activates said output current sink circuit, output current source circuit is inactive;

said stabilizing circuit causing said output current source circuit to source output current when (k·Vo−Vp1) <Vref, where Vp1 is a first predefined voltage; and said stabilizing circuit causes said output current sink circuit to sink output current when (k·Vo+Vp2) Vref, where Vp2 is a second predefined voltage.

6. The regulator of claim 1, wherein:

said stabilizing circuit includes a first two-input amplifier; and a second two-input amplifier;

said Vref coupled to a first input of said first amplifier, and said k·Vo coupled to a second input of said first amplifier;

an output of said first amplifier is coupled to a first input of said second amplifier, and said Vbias is coupled to a second input of said second amplifier;

an output of said second amplifier being coupled to said input node of said output current source circuit; and an output of said first amplifier being coupled to said input node of said output current sink circuit.

7. The regulator of claim 6, wherein:

said output of said first amplifier is proportional to (k·Vo−Vref); and said output of said second amplifier is proportional to (Vbias+Vref−k·Vo).

8. A regulator configured to provide a stable output voltage (Vo), comprising:

a stabilizing circuit coupled to a source circuit that can source an output current, and coupled to a sink circuit that can sink output current, said stabilizing circuit configured to transition said source circuit and said sink circuit between conductive and nonconductive states to stabilize said Vo;

said stabilizing circuit including a first amplifier that generates an error control signal, and a second amplifier;

said first amplifier including at least a first input and a second input, and being coupled to activate and transition said sink circuit between conductive and nonconductive states; wherein said fist input is coupled to receive at least a portion of said Vo, said second input is coupled to receive a reference voltage (Vref);

said second amplifier including at least a third input coupled to receive a bias voltage, and fourth input coupled to receive said error control signal generated by said first amplifier, said second amplifier coupled to transition said source circuit between conductive and nonconductive states;

wherein when said Vo≦Vref said stabilizing circuit transitions said source circuit to source output current and deactivates said sink circuit to prevent said sink current from sinking output current; and when said Vo≧Vref, said stabilizing circuit transitions said sink circuit to sink output current and deactivates said source circuit to prevent said source circuit from sourcing output current.

9. The regulator of claim 8, wherein:

said source circuit includes at least a first MOS transistor to source output current; and said sink circuit includes at least a second MOS transistor to sink output current.

10. The regulator of claim 8, wherein:

said source circuit includes at least a first NMOS transistor to source output current, and said sink circuit includes at least a second NMOS transistor to sink output current; and said stabilizing circuit transitions said first NMOS transistor to a conductive state to source output current, and transitions said second NMOS transistor to a nonconductive state to prevent said second NMOS transistor from sinking the output current when Vo≦Vref; and said stabilizing circuit transitions said second NMOS transistor to a conductive state to sink output current, and transitions said first NMOS transistor to a nonconductive state to prevent said first NMOS transistor from sourcing output current when Vo≧Vref.

11. The regulator of claim 8, wherein:

said stabilizing circuit transitions said first MOS transistor to source output current when Vo≦(Vref−a first predefined voltage); and said stabilizing circuit transitions said second MOS transistor to sink output current when Vo≧(Vref+a second predefined voltage).

12. The regulator of claim 8, wherein:

when said error control signal exceeds a third predefined voltage, said sink circuit transitions to a conductive state, and when said error control signal falls below a fourth predefined voltage said sink circuit transitions to a nonconductive state.

13. The regulator of claim 12, wherein:

said error control signal exceeds said third predefined voltage when Vo≦Vref.

14. The regulator of claim 8, wherein:

said second amplifier is configured to generate a source activation signal such that when said source activation signal exceeds a fifth predefined voltage, said source circuit transitions to a conductive state, and when said source activation signal falls below a sixth predefined voltage, said source circuit transitions to a nonconductive state.

15. The regulator of claim 14, wherein:

said source activation signal exceeds said fifth predefined voltage when said error control signal is approximately ≦said Vbias.

16. The regulator of claim 12, wherein:

said error control signal is approximately ≦Vbias when Vo≦Vref.

17. The regulator of claim 11, wherein each said predefined voltage is substantially equal.

18. The regulator of claim 12, wherein each said predefined voltage is substantially equal.

19. The regulator of claim 13, wherein each said predefined voltage has at least one characteristic selected from a group consisting of (a) each said predefined voltage is substantially equal, and (b) each said predefined voltage approximates gate-source voltage for a MOS transistor.

20. An apparatus to provide a stable output voltage Vo, comprising:

a stabilizing circuit coupled to a source circuit that can source an output current, and to a sink circuit that can sink an output current, and configured to transition one of said source circuit and said sink circuit to a conductive state to stabilize Vo at a predefined voltage;

a feedback path coupling at least a fraction of said Vo as an input to said stabilizing circuit;

said stabilizing circuit including a first amplifier having a first input and a second input wherein the first input couples with said feedback path to receive at least said fraction of said Vo, and the second input configured to receive a reference voltage (Vref), said first amplifier configured to generate an error control signal useable to transition said sink circuit between conductive and non-conductive states;

said stabilizing circuit further including a second amplifier having a third input configured to receive a first bias voltage (Vbias), and having a fourth input configured to receive said error control signal, said second amplifier further configured to supply a source activation signal to transition said source circuit between conductive and nonconductive states;

said stabilizing circuit configured to transition said source circuit and said sink circuit between a conductive state and a nonconductive state such that cross-conductance is prevented.

21. The apparatus of claim 20, wherein:

said source activation signal is proportional to a voltage difference between Vbias and said error control signal.

22. The apparatus of claim 20, wherein:

said error control signal is proportional to a voltage difference between Vref and Vo.

23. The apparatus of claim 20, wherein:

said source circuit includes at least one MOS transistor; and said sink circuit includes at least one MOS transistor.

24. The apparatus of claim 20, wherein:

said source circuit includes at least one NMOS transistor; and said sink circuit includes at least one NMOS transistor.

25. The apparatus of claim 20, wherein:

said stabilizing circuit is configured to activate only one of said source circuit and said sink circuit at a time.

26. A voltage regulator configured to supply a substantially constant output voltage Vo, comprising:

a first amplifier having a first input coupled with an output node of said regulator providing said Vo to receive at least a fraction of said Vo, and having a second input coupled to a reference voltage (Vref), said first amplifier configured to generate an error control signal to initiate sinking of output current from said output node when $Vo \geqq Vref$;

a sink circuit coupled between an output of said first amplifier and said output node providing said Vo, said sink circuit configured to sink output current responsive to said error control signal;

a second amplifier coupled to an output of said first amplifier, and having a third input coupled to receive a bias voltage (Vbias) and having a fourth input coupled to receive said error control signal output from said first amplifier, said second amplifier configured to initiate sourcing of output current to said output node when said error control signal is approximately $\leqq$Vbias.

27. The voltage regulator of claim 26, wherein:

said second amplifier initiates sourcing of output current when $Vo \leqq Vref$.

28. The voltage regulator of claim 26, further including:

a source circuit coupled between an output of said second amplifier and said output node providing Vo, said source current configured to source output current responsive to an output from said second amplifier.

29. The voltage regulator of claim 28, wherein said second amplifier initiates sourcing of output current when $Vo \leqq Vref$.

30. A method to provide a stable output Vo, comprising the following steps:

providing an output current source circuit;

providing an output current sink circuit;

providing a source of reference voltage Vref;

providing a source of bias voltage Vbias;

coupling a stabilizing circuit to said output current source circuit, to said output current sink circuit, to a fraction k ($0<k\leqq 1$) of said Vo, to said Vref, and to said Vbias;

said stabilizing circuit configured to couple a signal proportional to ($k \cdot Vo - Vref$) to an input node of said output current sink circuit, and to couple a signal proportional to ($Vbias - k \cdot Vo + Vref$) to an input node of said output current source circuit;

said stabilizing circuit transitioning said output current source circuit and said output current sink circuit between conductive and non-conductive states to stabilize magnitude of said Vo as a function of relative magnitudes of k·Vo and Vref and Vbias.

31. The method of claim 30, wherein:

providing said output current source circuit includes providing a first NMOS device having a gate lead as an input node; and providing said output current sink circuit includes providing a second NMOS device having a gate lead as an input node;

wherein when ($k \cdot Vo \leqq Vref$), said stabilizing circuit causes said first NMOS device to source output current, and prevents said second NMOS device from sinking output current; and when ($k \cdot Vo \leqq Vref$), said stabilizing circuit prevents said first NMOS device from sourcing output circuit, and causes said second NMOS device to sink output current.

32. The method of claim 31, wherein:

when said output current source circuit sources current, said output current sink circuit does not sink current; and when said output current sink circuit sinks current, said output current source circuit does not source current.

33. The method of claim 31, wherein:

when said stabilizing circuit activates said output current source circuit, said output current sink circuit is inactivate; and when said stabilizing circuit activates said output current sink circuit, output current source circuit is inactive;

said stabilizing circuit causes said output current source circuit to source output current when ($k \cdot Vo - Vp1$) $<Vref$, where Vp1 is a first predefined voltage; and said stabilizing circuit causes said output current sink circuit to sink output current when ($k \cdot Vo + Vp2$) Vref, where Vp2 is a second predefined voltage.

* * * * *